US009125438B2

(12) United States Patent
Adler et al.

(10) Patent No.: US 9,125,438 B2
(45) Date of Patent: Sep. 8, 2015

(54) COMBINED BABY BIB AND SUPPORTING BOTTLE HOLDER

(71) Applicants: Daniel Adler, San Jose, CA (US); Claire Adler, San Jose, CA (US)

(72) Inventors: Daniel Adler, San Jose, CA (US); Claire Adler, San Jose, CA (US)

( * ) Notice: Subject to any disclaimer, the term of this patent is extended or adjusted under 35 U.S.C. 154(b) by 267 days.

(21) Appl. No.: 13/933,572

(22) Filed: Jul. 2, 2013

(65) Prior Publication Data

US 2014/0007313 A1 Jan. 9, 2014

Related U.S. Application Data

(60) Provisional application No. 61/669,014, filed on Jul. 7, 2012.

(51) Int. Cl.
*A41B 13/00* (2006.01)
*A41B 13/10* (2006.01)

(52) U.S. Cl.
CPC ..... *A41B 13/103* (2013.01); *A41B 13/10* (2013.01)

(58) Field of Classification Search
CPC ..... A41B 13/00; A41B 13/103; A41B 13/10
USPC ..... D2/864, 860; 248/102–106; 224/148.1, 224/148.4; 5/603, 644
See application file for complete search history.

(56) References Cited

U.S. PATENT DOCUMENTS 298,985 A * 5/1884 Kimball ..... 2/49.2
1,582,517 A * 4/1926 Gurwitz ..... 2/51
2,451,718 A * 10/1948 Corrao ..... 248/105
2,617,105 A * 11/1952 Backman ..... 2/48
2,631,288 A * 3/1953 Daust ..... 2/49.3
3,095,576 A * 7/1963 Jenter ..... 2/51
3,945,048 A * 3/1976 Shearer ..... 2/48
4,473,907 A * 10/1984 Maillard ..... 2/48
4,924,527 A * 5/1990 Hintermeyer ..... 2/46
5,048,121 A * 9/1991 Kordecki ..... 2/49.4
5,312,282 A * 5/1994 Cooper ..... 446/27
5,432,952 A * 7/1995 Tate ..... 2/49.4
5,483,701 A * 1/1996 Ferreyros ..... 2/49.2
5,490,289 A * 2/1996 Lehrer ..... 2/49.2
5,661,851 A * 9/1997 Sanchez ..... 2/49.4
5,765,225 A * 6/1998 Goeckeritz et al. ..... 2/49.1
5,820,084 A * 10/1998 Trumbauer et al. ..... 248/102
D403,489 S * 1/1999 Cameron ..... D2/864
6,055,667 A * 5/2000 Jimenez ..... 2/49.1
D432,759 S * 10/2000 Krolczyk et al. ..... D2/864
6,308,333 B1 * 10/2001 Jackson ..... 2/49.4
6,769,136 B1 * 8/2004 Martelly ..... 2/51
6,961,961 B1 * 11/2005 Ezra ..... 2/49.1
7,032,248 B1 * 4/2006 Gutilla ..... 2/49.1
7,484,249 B1 * 2/2009 Reese et al. ..... 2/48
8,161,571 B1 * 4/2012 Beaupain ..... 2/49.1
2004/0205876 A1 * 10/2004 Bruffett ..... 2/49.2
2005/0103954 A1 * 5/2005 Touma ..... 248/103
2009/0044307 A1 * 2/2009 Johnson ..... 2/49.1
2010/0107294 A1 * 5/2010 Gillian ..... 2/49.5
2010/0199400 A1 * 8/2010 Graffeo ..... 2/49.1
2013/0019369 A1 * 1/2013 Bailey et al. ..... 2/49.2
2014/0007313 A1 * 1/2014 Adler et al. ..... 2/49.2

* cited by examiner

*Primary Examiner* — Danny Worrell
*Assistant Examiner* — Khaled Annis
(74) *Attorney, Agent, or Firm* — Andrew W. Chu; Craft Chu PLLC

(57) ABSTRACT

A bib and bottle holder is described that secures and orients a nursing bottle at a tilted position for a bottle nursing baby to relieve a person from having to hold the bottle while baby nurses the bottle.

20 Claims, 10 Drawing Sheets

COMBINED BABY BIB AND SUPPORTING BOTTLE HOLDER

RELATED APPLICATIONS

This application is a non-provisional patent application of and related to U.S. Provisional Patent Application Ser. No. 61/669,014 filed Jul. 7, 2012 entitled "COMBINED INFANT BIB AND SUPPORTING BOTTLE HOLDER", which is incorporated herein by reference in its entirety, and claims any and all benefits to which it is thereby entitled.

BACKGROUND OF THE INVENTION

1. Field of the Invention

The combined baby bib and bottle holder relates to a multi-function bib for babies, and more particularly to a baby bib with a handfree secure bottle position structure that can be optionally implemented.

2. Description of the Prior Art

A person is usually required to hold a bottle for a baby while bottle nursing. This prevents the person bottle nursing the baby from freely using one of their hands to perform other tasks simultaneously. Typically, the person needs one hand to hold the baby and the other hand to secure the position of a bottle during nursing. This can be very inconvenient for the person nursing the baby who may need to carry out other tasks while the baby is bottle nursing such as using a phone, eating, drinking or other various personal needs. It is also very tiring for the arm holding the bottle and can cause strain and discomfort in the lower back. There are needs in the market for a product that a bottle nurser can use to hold and secure the bottle position while the baby nurses when situations arise. Conventional bibs only serve as garment protectors to keep the baby dry while bottle nursing by absorbing any spilt liquid from the bottle or baby's mouth.

The combined baby bib and bottle holder of this application is a combination of a bib and a handsfree bottle holder that provides a solution to this problem by holding and supporting the bottle while the baby nurses

ADVANTAGES AND SUMMARY OF INVENTION

A combined baby bib and bottle holder supporting hands-free bottle nursing is described that is composed mostly of standard materials found in conventional bibs, making it portable and convenient to carry in a purse/bag or even a pocket. In addition, the combined baby bib and bottle holder when implemented, incorporates a tilted concave surface for supporting and securing bottles of various sizes and liquid quantities to allow the baby to nurse a bottle without assistance. The bottle is held securely in place to allow a person to use their hands freely while nursing the baby. The combined baby bib and bottle holder is also designed to prevent the bottle from falling on the ground as the baby moves yet still allows the bottle to move in a slightly restricted motion while still maintaining balance and rigidity at a tilted position.

The combined baby bib and bottle holder is constructed of a flexible material, which makes it adjustable and allows the feeder to position the bottle as desired. It also allows the baby to move freely and naturally during nursing and allows the baby to stop nursing, disengage from and reattach with the bottle nipple at will.

The combined baby bib and bottle holder can be worn at all times and nursing can take place without restriction to a single fixed position with combined bib and bottle holder resting comfortably on the baby's chest. The combined baby bib and bottle holder also includes a reversible and detachable mini bib.

Further details, objects and advantages of the combined baby bib and bottle holder will become apparent through the following descriptions, and will be included and incorporated herein.

DESCRIPTION OF PREFERRED AND EXEMPLARY EMBODIMENTS

A combined baby bib and bottle holder supporting hands-free bottle nursing is described that is composed mostly of standard features and materials found in conventional bibs, making it portable and convenient to carry in a purse/bag or even a pocket. In addition, the combined baby bib and bottle holder, when deployed, incorporates a tilted open compartment to support and secure bottles of various sizes and liquid quantities to allow the baby to nurse a bottle without assistance. The bottle is held securely in place to allow the person bottle nursing the baby free use of at least one hand while the baby nurses. The combined baby bib and bottle holder is also designed to secure the bottle to the bib and move with the bib when the baby moves around maintaining balance and rigidity at a tilted position.

The combined baby bib and bottle holder is constructed of a flexible material, which makes it adjustable and allows the feeder to position the bottle as desired and baby to move freely and naturally while nursing.

Further details, objects and advantages of the combined baby bib and bottle holder will become apparent through the following descriptions.

For a better understanding of the invention reference is made to the following detailed description of the preferred embodiments thereof which should be taken in conjunction with the prior described drawings.

DETAILED DESCRIPTION OF THE PREFERRED EMBODIMENT

The description that follows is presented to enable one skilled in the art to make and use the combined baby bib and bottle holder, and is presented in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

With reference to the accompanying drawings, the combined baby bib and bottle holder will be described using identical numbers throughout the different views of the combined baby bib and bottle holder to identify exact or component parts. The structure and use of the combined baby bib and bottle holder will also be discussed.

Figure 1:
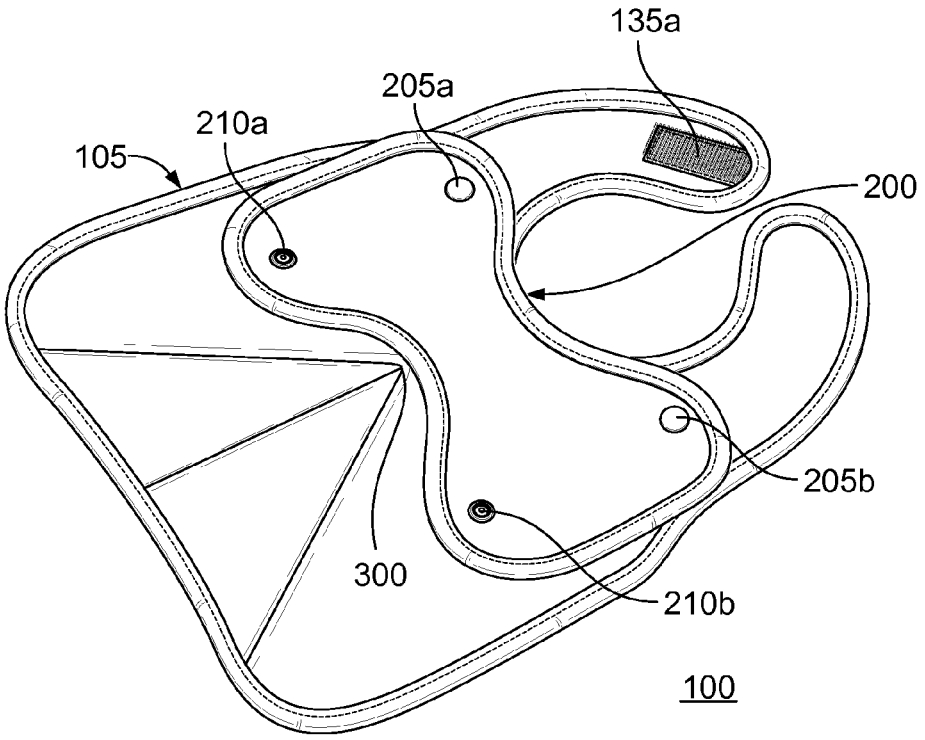
FIG. 1 is a representative top view showing the front panel of combined baby bib and supporting bottle holder 100 with mini bib 200 fastened to it.
Figure 2:
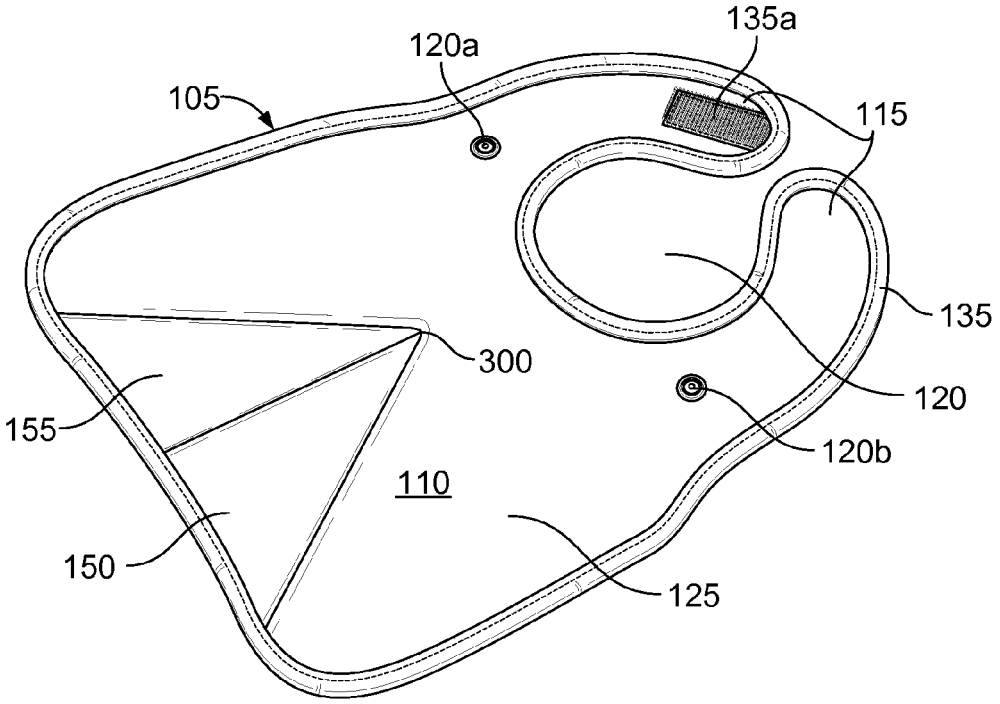
FIG. 2 is a representative top view showing the front panel of combined baby bib and supporting bottle holder 100 without mini bib 200 fastened.

FIGS. 1 & 2 are representative top views showing the front panel of combined baby bib and supporting bottle holder 100 with and without the reversible, detachable mini bib 200. As best shown in FIG. 1, combined baby bib and supporting bottle holder 100 resembles a conventional baby bib consisting essentially of an oblong main bib 105 and a detachable and reversible mini bib 200.

With reference to FIGS. 3 & 3A-3C the top half of the detachable, reversible mini bib 200 snaps on and off the main bib 105 preferably using polyacetal resin snap fasteners. The purpose of making mini bib 200 reversible is to increase the numbers of uses by simply reversing mini bib 200 when one side gets dirty or soaked, thus enhancing both garment protection and the convenience of the combined baby bib and bottle holder 100. As shown in FIG. 2, halves of snap fasteners 120*a* and 120*b* are attached permanently to front at the top of body portion 110 of main bib 105. The snaps fastener halves 120*a* and 120*b* snap onto correspondingly located snap halves of 205*a* and 205*b* on mini bib 200; and when reversed, snap halves 210*a* and 210*b*. Alternatively, mini bib 200 can be fastened to main bib 105 with hook and loop couplings, magnets, and metal snap fasteners.

Figure 4:
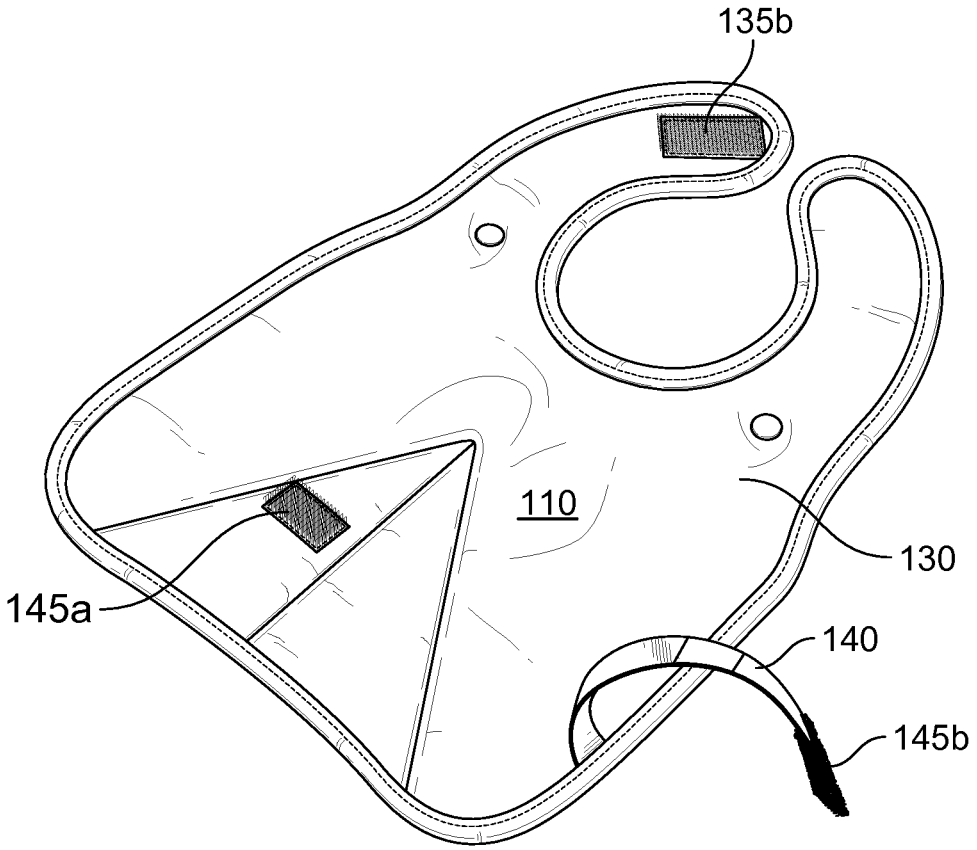
FIG. 4 is a representative top view showing the back panel of combined baby bib and supporting bottle holder 100 with an elastic strap 140 unfastened.
Figure 14:
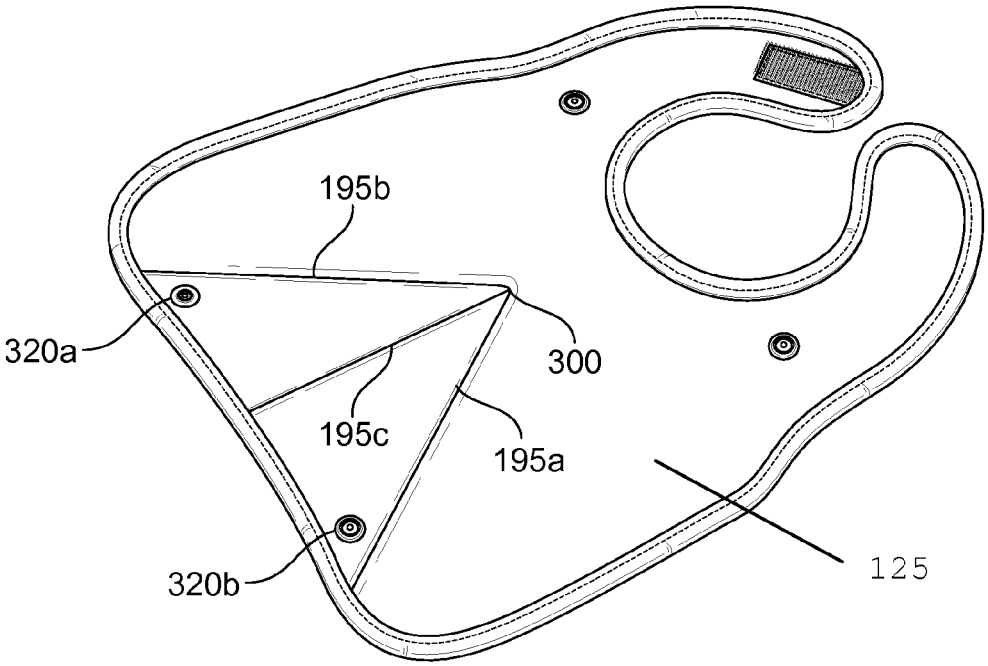
FIG. 14 is a representative top view of combined baby bib and supporting bottle holder 100 with an alternative deployment embodiment.

As best shown in FIG. 2, in one embodiment, main bib 105 is in a shape of a conventional baby bib, formed integrally by an oblong rectangular body portion 110, and two neck arms 115 extending from the top of the body portion 110. The two neck arms 115 curve around a baby's neck providing a circular neck opening 120. The main bib 105 is constructed by two identically shaped and sized fabric layers, viz. the front fabric layer 125 as shown in FIGS. 2 & 14, and the rear fabric layer 130 as shown in FIG. 4. The two fabric layers 125 and 130 are secured together by a perimeter seam with bias tape seam 135. The front fabric layer 125 is composed of an absorbent cloth such as jersey cotton. Alternative fabric materials may be woven cotton, terrycloth or fleece, and the like. As shown, a bias tape seam 135 can be sewn and/or adhered around the perimeter of main bib 105. The bias tape 135 can also be a jersey, cotton, polyester blend or an interlock cotton fabric. As shown in FIGS. 1 and 4, hook and loop couplings 135*a* and 135*b*, preferably strips of Velcro®, are sewn/adhered on the tip of neck arms 115. Conventionally, the loop half 135*a* is sewn on one neck arm 115 of front fabric layer 125 and the hook half 135*b* is sewn on the other neck arm 115 of rear fabric layer 130. The main purpose of hook and loop coupling 135*a* and 135*b* is to close neck opening 120 such that combined baby bib and supporting bottle holder 100 hangs securely around the baby's neck, covering the baby's shoulders, chest and tummy. Alternatively, a snap fastener could be used instead of hook and loop coupling 135*a* and 135*b* for the same function. The strip hook and loop couplings 135*a* and 135*b* allow for adjustment of tightness of the neck opening 120 by users according to the size of the baby's neck, and to ensure a secure, snug and comfortable fit.

Figure 3:
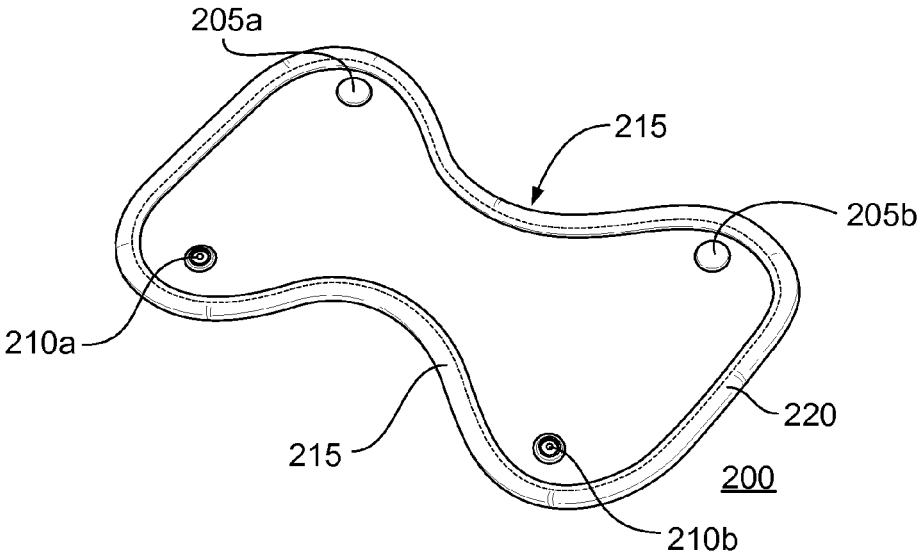
FIG. 3 is a representative top view of mini bib 200.
Figure 10:
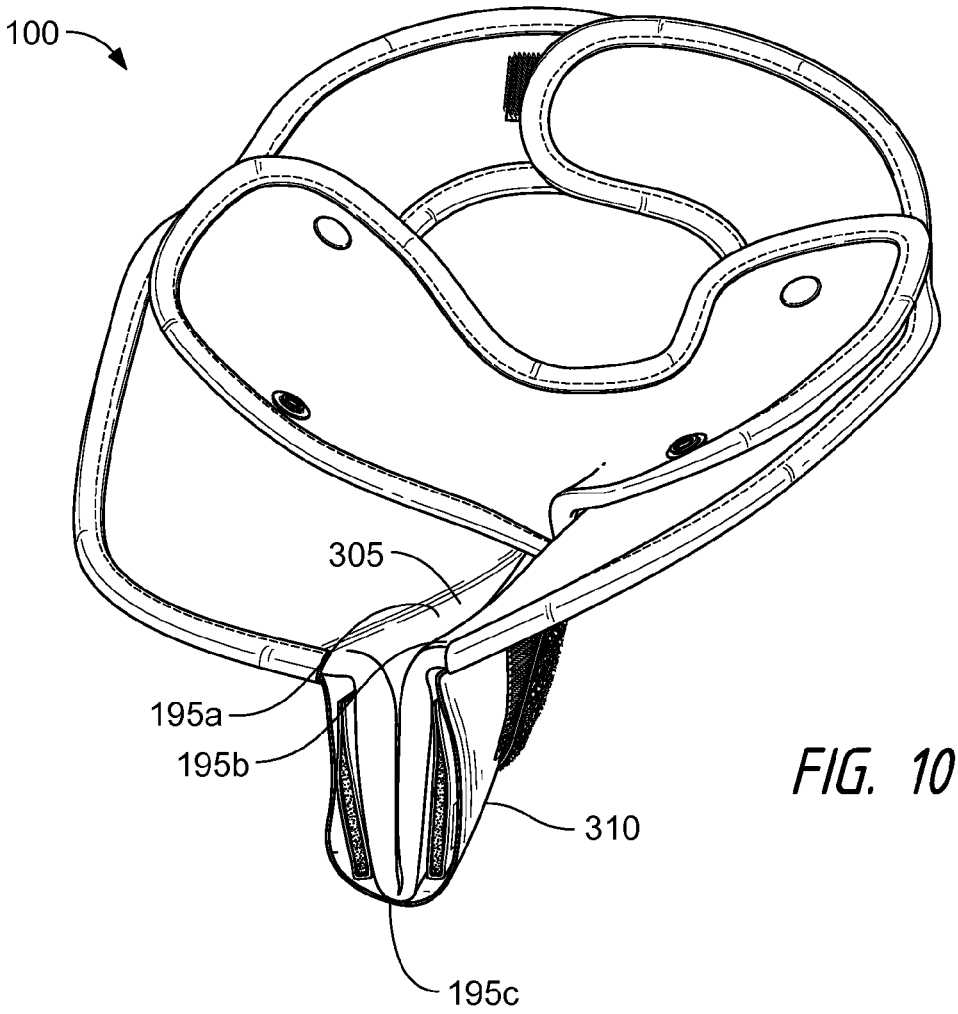
FIG. 10 is a representative isometric view of combined baby bib and supporting bottle holder 100 in a deployed mode.

FIG. 3 is a representative top view of the mini bib 200 which is unique to the combined baby bib and bottle holder 100 in utility, use and function. As shown in FIG. 3, mini bib 200 is bow-shaped to allow clearance of the deployment of the present invention 100, as best shown in FIG. 10. Moreover it allows for maximum protection from liquid leakage to prevent main bib 105 and baby's clothing from becoming soaked. With conventional bibs, liquid that leaks from a bottle and/or baby's mouth tends to collect mainly at the top of the bib area under the baby's chin which sops the bib top very quickly. As previously discussed, since the mini bib 200 is reversible and snapped at the top of body portion 110 of main bib 105, it will collect most of the leakage and when sopped, can then be unsnapped from the main bib 105, and either wrung, reversed or replaced with one or more such mini bibs 200 without excessively soiling the main bib 105. The rounded indentations 215 of the bow-shaped mini bib 200 allows easy access to baby's mouth and chin for wiping away leakage during feeding.

The mini bib 200 is made of three identical shaped and sized layers. In one embodiment, the top and bottom layers are made of absorbent fabric material such as jersey cotton. Alternatively the top and bottom layers of the mini bib 200 can be made of fabric materials such as woven cotton, terry cotton or fleece. The in-between layer is made of non-permeable and non-toxic fabric material such as a polyester/polyurethane blended fabric known as Baby Dry Flannel Backed Vinyl to waterproof the top layer of mini bib 200 from the bottom layer, and vice versa. Materials like Baby Dry Flannel Backed Vinyl are waterproof and safe for babies. As best shown in FIG. 3, a bias tape seam 220 is sewn around the perimeter of the mini bib 200. A polyester blend or interlock cotton fabric can also be used as bias tape 220. In one embodiment, fastener halves 205*a*, 205*b*, 210*a* and 210*b* are sewn/adhered permanently on four corner of mini bib 200 for fastening the mini bib 200 to main bib 105 at fasten halves 120*a* and 120*b*, as best shown in FIG. 1.

Figure 3A:
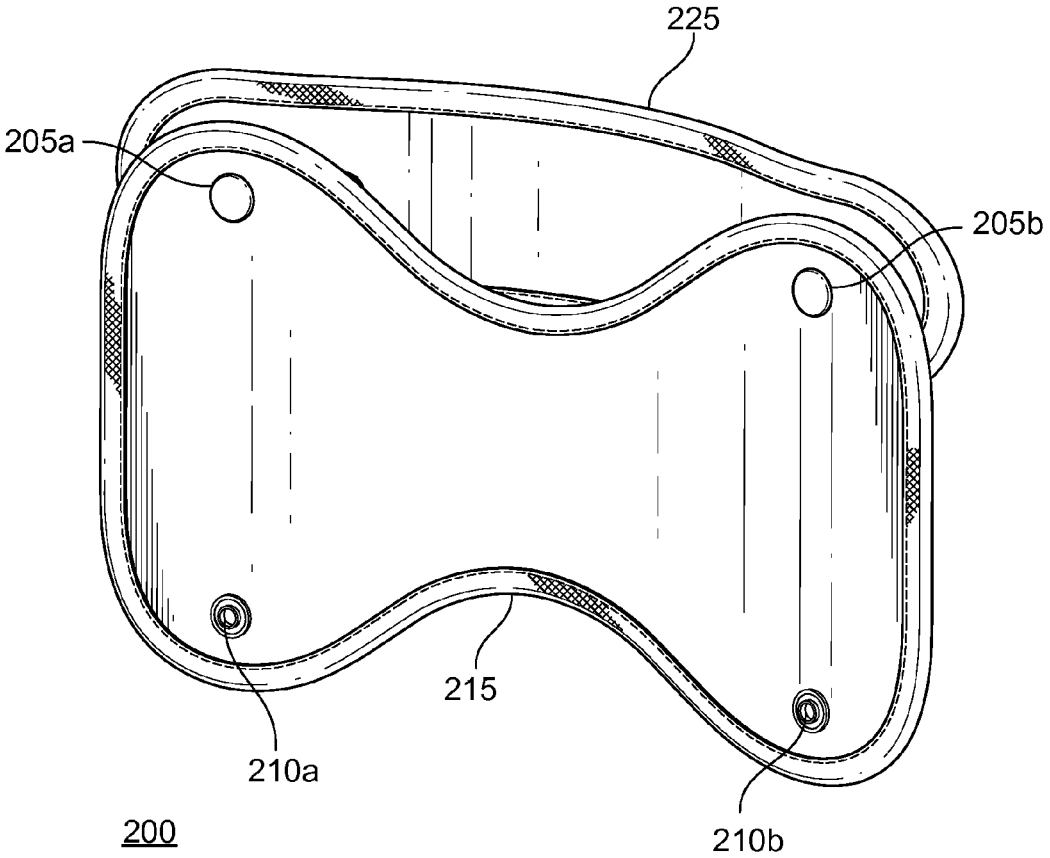
FIG. 3A is a representative isometric front view of mini bib 200.
Figure 3B:
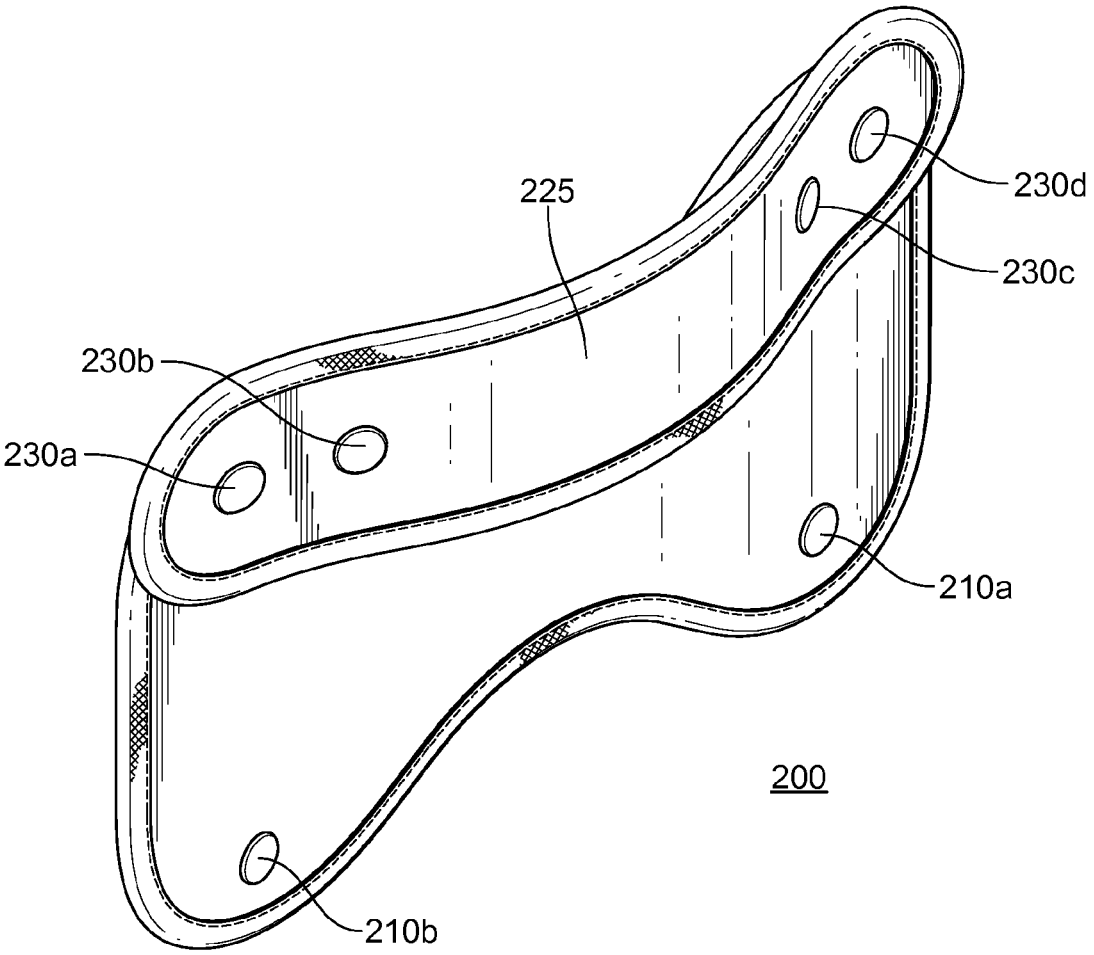
FIG. 3B is a representative isometric back view of mini bib 200.

Turning to FIGS. 3A & FIG. 3B showing isometric front and back views of the mini bib 200 with neck strap 225 which allows mini bib 200 to function as a conventional bib with the neck strap 225 encircling the baby's neck and fastened to and unfastened from the mini bib 200. The neck strap 225 can be made from the same materials and layers of mini bib 200, preferably comfortable when snuggly secured around the baby's neck. As shown in FIG. 3B, neck strap 225 is fastened to mini bib 200 by the snap fasteners halves 230*a* and 230*d* or

Figure 3C:
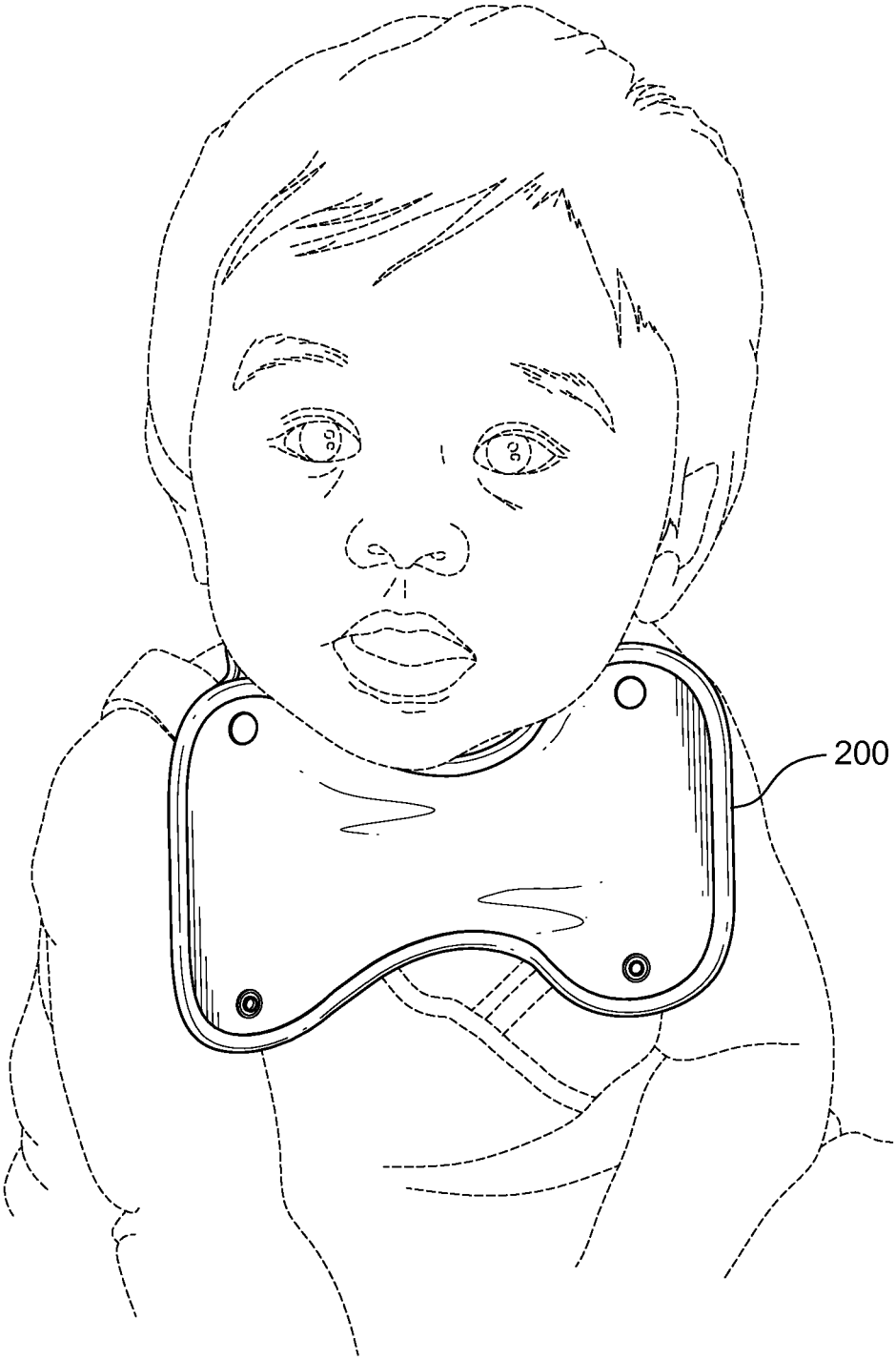
FIG. 3C shows a method of use of mini bib 200.

230*a* and 230*c* or 230*b* and 230*c* depending on the fit, to fasteners 205*a* and 205*b* or 210*a* and 210*b* on mini bib 200. As shown in FIG. 3C, neck strap 225 fits around the baby's neck locating mini bib 200 under the baby's chin. The main purpose of mini bib 200 in this instance is to collect drools from the baby's mouth.

Figure 5:
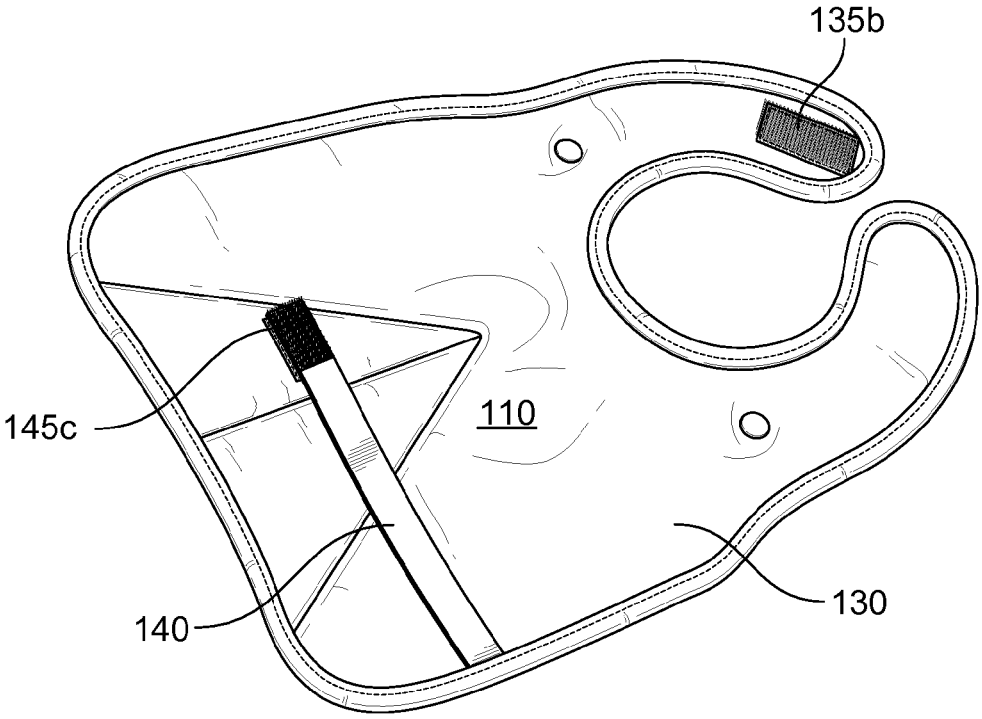
FIG. 5 is a representative top view showing the back panel of combined baby bib and supporting bottle holder 100 with the elastic strap 140 fastened.
Figure 6:
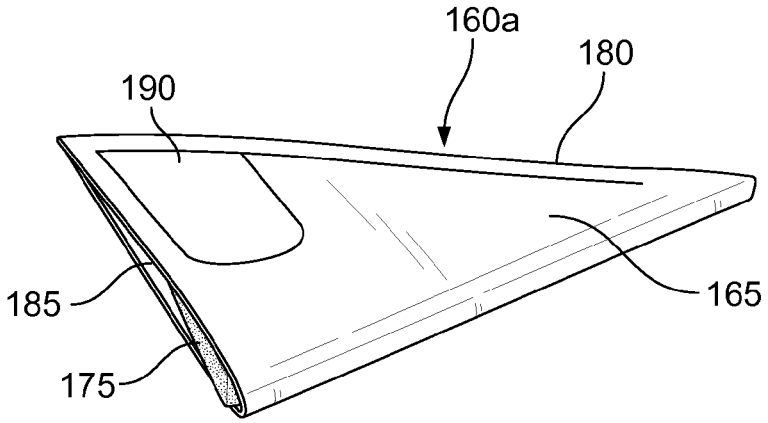
FIG. 6 is a representative top view of bib insert 160*a* & 160*b*.

With reference to FIGS. 4 & 5 showing representative top views of the back surfaces of the baby bib and bottle holder 100, the rear fabric layer 130 of main bib 105 functions as a protective barrier between front fabric layer 125 and baby's clothing to prevent the clothing from becoming soaked. Preferably, the rear fabric layer 130 is composed of a non-permeable and non-toxic fabric material layer such as a polyester/polyurethane blended fabric known as Baby Dry Flannel Backed Vinyl. Materials like Baby Dry Flannel Backed Vinyl are waterproof and safe for babies. Moreover, rear fabric layer 130 is sufficiently stiff for providing support when the main bib 105 is transformed for holding as it is deployed, supporting and tilting a nursing bottle 400 within a formed concave cradling surface 305 (see FIG. 10) freeing at least one hand when a person bottle nurses a baby.

Figure 11:
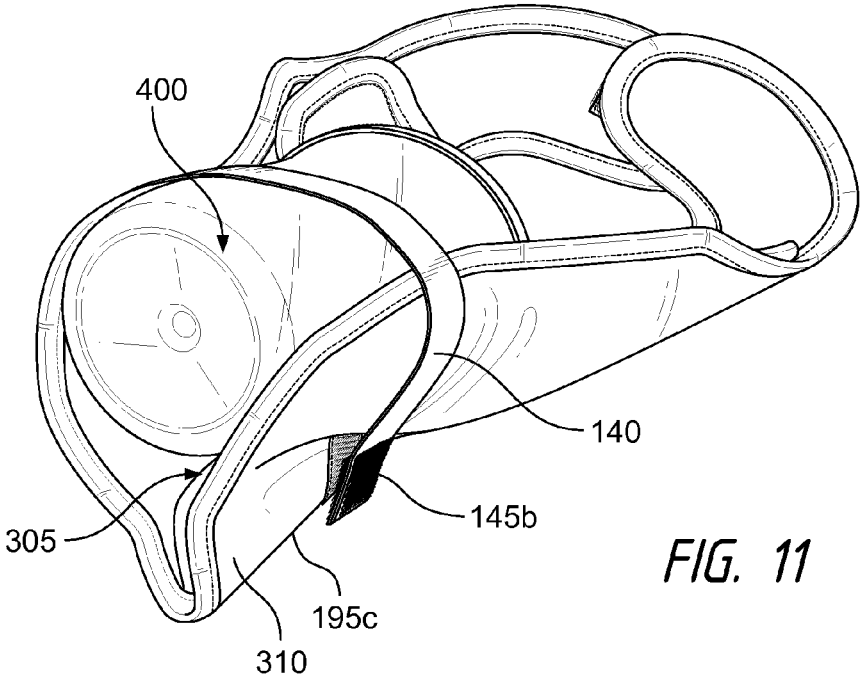
FIGS. 11 and 12 are representative isometric views of combined baby bib and supporting bottle holder 100 of the present invention deployed with a bottle.

One end of an elastic strap 140 is sewn to a back side edge of main bib 105. The other end of the strap 140 attaches onto and detaches from rear fabric layer 130 of the main bib 105. As best shown in FIG. 4, the elastic strap 140 is approximately three to five inches from the bottom of the main bib 105. The elastic strap 140 is preferably composed of an elastic material allowing stretching along its length and further has loop fastener patches 145*b* and 145*c* respectively sewn/adhered to either side of the free distal tip of elastic strap 140. Loop fastener patch 145*b* secures the elastic strap 140 to rear layer 130 at hook patch 145*a* when the bottle holder function of the present invention 100 is not implemented (see FIG. 5). Alternatively, magnetic fasteners, polyacetal resin snap fasteners or metal snap fasteners can be used instead of hook and loop couplings 145*a* and 145*b*/145*c* to secure the knitted elastic strap 140 to rear fabric layer 130. With reference to FIG. 11, when the bottle holder function of the present invention 100 is implemented (in use), the elastic strap 140 stretches around the back surface of the rear fabric layer 130 and is secured by loop patch 145*c* and hook patch 145*a*.

Referring back to FIGS. 6, 7, 8 & 9, illustrating details, respectively, of the main bib 105, with symmetrical (left and right) insert pockets 150 & 155, and corresponding symmetrical (left and right) bib inserts 160*a* & 160*b*, The symmetrical right bib inserts 160*a* & 160*b* each comprise of a flat and right-triangular shaped pad with 3 components (FIGS. 6-9), namely an outer casing 165, a foam layer 175 and neodymium disc magnet 170. The outer casing 165 comprises of a folded isosceles triangle panel of Peltex® fabric material or other similar ultra-firm, resilient, and washable stabilizer material. Suitable isosceles triangle fabric panel should have a base dimension ranging between 4 to 6 inches and height dimension ranging between 3 to 4 inches. Two folding lines 165*b* and 165*c* are drawn on both sides of a perpendicular bisector line 165*a* of the isosceles triangle fabric panel with an approximate clearance of ¼ inch on either side of the bisector line 165*a*. The outer casing 165 is then folded along fold lines 165*b* and 165*c*, creating a right triangle outer casing 165 with an approximate thickness ranging between ¼ to ½ inch and an edge seam or sealing closing the inclined edges 180 of the so folded triangle fabric panel together creating a right triangle shaped pouch.

Figure 9:
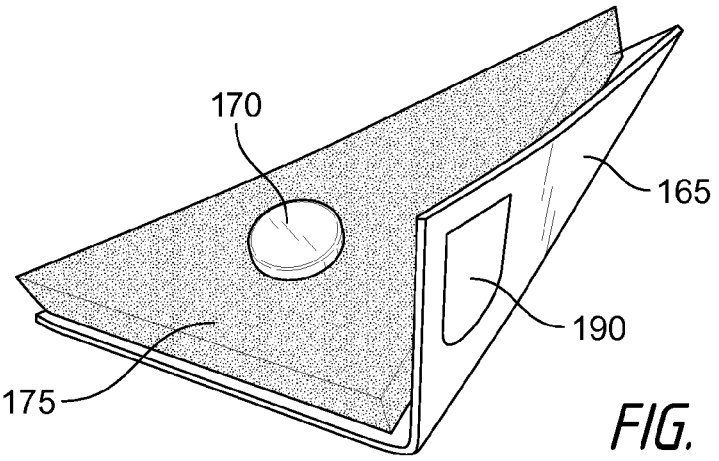
FIG. 9 is an expanded top view showing method of assembly of bib inserts 160*a* & 160*b*.

As shown in FIG. 9, symmetrical (left and right) bib inserts 160*a* & 160*b* each have a foam pads 175 shaped and sized to be inserted in the created pouches through corresponding left and right pouch opening 185. The foam pads 175 are secured by stitching them in between and along the hypotenuse edges 180 of the folded outer casing 165. A neodymium disc shaped magnet 170 is preferably located and optionally bonded to the front faces of foam pads 175 proximate the respective base acute angles. In one preferred embodiment, the neodymium disc shaped magnets 170 is secured in pockets 190 sewn on the inside surface of the isosceles triangle fabric panel at one of acute base corners of the isosceles triangle fabric panel (FIG. 6) sized and configured to receive the particular magnets 170. Such pockets 190 also could be stitched to the pads 175 in a way that a sew which stitches through the pads 175 and into the opposite side surface of the isosceles triangle to create a strong insert. Suitable neodymium disc magnets 170 with diameters of ½ inch and approximate thickness of ⅛ inch that provide an approximate minimum pull force of 5.2 pounds when opposite poles are linked. However, other magnets of various sizes, shapes and comparable attractive force when opposite poles are joined would also be suitable.

Figure 7:
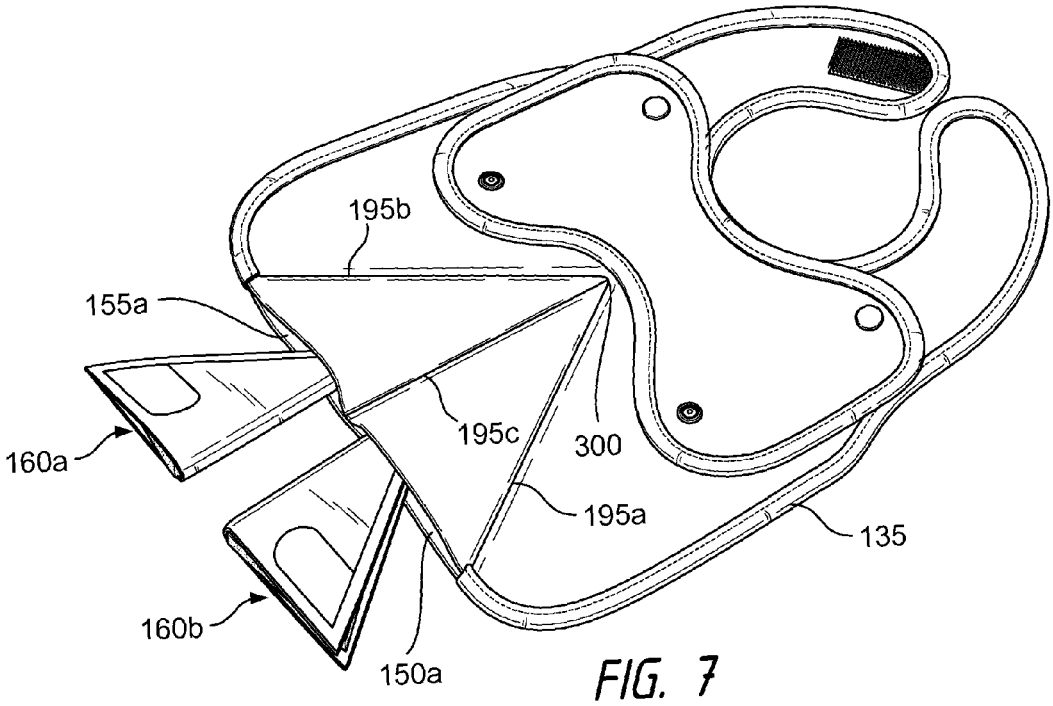
FIG. 7 is a representative top view showing method of assembly of bib inserts 160*a* and 160*b* for the combined baby bib and supporting bottle holder 100.
Figure 8:
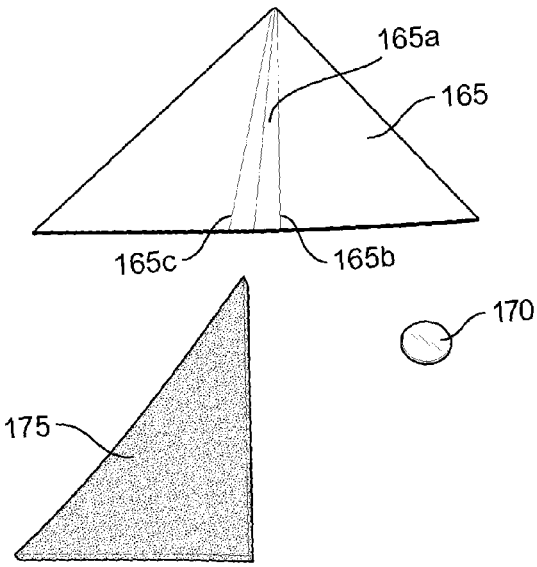
FIG. 8 is a representative top view of bib insert 160*a* showing the separate components.

As shown in FIGS. 2 and 7, adjacent symmetrical (left and right) right triangle pockets 150 and 155 are created between front fabric layer 125 and rear fabric layer 130 of main bib 105 secured together by hypotenuse seams 195*a*, & 195*b*, and a common perpendicular seam 195*c* joining at a seam apex 300, forming two symmetrical right-angle triangle pockets 150 and 155 (also an isosceles triangle with a perpendicular bisector). The front and rear fabric layers 125 and 130 of the main bib 105 are not closed by a bias tape seam 135 across the bottoms of the triangular pockets 150 and 155 providing openings 150*a* and 155*a*. The triangular pockets 150 and 155 are sized to provide a snug fit for receiving left and right bib inserts 160*a* and 160*b*. Additionally, front poles of the respective neodymium respective magnets 170 secured on the front surfaces with the pouches of the left and right (symmetrical) bib inserts 160*a* and 160*b* are of opposite polarity. Bib inserts 160*a* and 160*b* are accordingly inserted in the corresponding triangular pockets 150 and 155. In one preferred embodiment, after inserting bib inserts 160*a* and 160*b*, triangular pockets 150 and 155 are completely sealed by bias tape seam 135 as shown in FIGS. 1 & 2, making the bib inserts 160*a* and 160*b* permanent components of the combined bib and bottle holder 100. Alternatively, openings 150*a* and 155*a* are left open completely or partially to allow removal, (and replacement) of the inserts 160*a* and 160*b* for using/washing combined baby bib and bottle holder 100 without the bib inserts 160*a* and 160*b*. In another embodiment, the base of the pockets 150 & 155 may be closed with a bias tape seam proximate their respective base corners shortening the openings 150*a* and 150*b* such that the respective inserts 160*a* and 160*b* are supported within the pockets 150 & 155, once inserted, by the bias tape seam 135 closing the corners of the pockets.

As shown in FIG. 10, to implement the bottle holder function, the front surface of the main bib 105 is folded together along the common perpendicular seam 195*c* for joining the hypotenuse seams 195*a* and 195*b* of the symmetrical right triangle pockets 150 & 155 containing the left and right bib inserts 160*a* and 160*b* together. The opposite pole faces of the neodymium disc shaped magnets 170 in left and right bib inserts 160*a* and 160*b* magnetically link up to hold the folded configuration of front surface of main bib 105 joining the hypotenuse 195*a* and 195*b* seams. The normally, flat front surface of the main bib 105 is transformed into a centrally located concave cradling surface 305. The fold transforms the normally flat back surface of the main bib 105 joining the right angle triangle pocket 150 and 155 containing the right bib insets 160*a* and 160*b* with their foam pads 175, into a centrally located, right triangle shaped shoulder fold 310 with the common perpendicular seam 195*c* at the bottom of the fold leg that extends from the seam apex 300 in the central region of the bib body 110 with increasing elevation toward the bottom end of the transformed main bib 105 for stably supporting the concave cradle surface 305 and a full baby bottle 400. The elastic strap 140, wrapping and securing the sides of the main bib 105 around a baby bottle 400, provides necessary rigidity to the structurally transformed bottle holder configuration of the main bib 105. In particular, the axis of the so wrapped baby bottle 400 or other nursable container is aligned with the right triangle, shaped shoulder fold 310 that prevents the formed structure from folding vertically and/or horizontally. The width of the adjacent left and right bib inserts 160*a* and 160*b*, in the shaped shoulder fold 310 allows the transformed structure to rest comfortably on a baby's chest without collapsing.

More importantly, the right triangle, shaped shoulder fold 310 tilts the secured nursing nipple 405 at the top of the baby bottle 400 or other nursable container downward toward the face of a baby wearing the combined baby bib and bottle holder 100. Preferably, depending on the dimensions of triangular pockets 150 and 155 and the bib inserts 160*a* and 160*b*, when main bib 105 is transformed to implement the bottle holder function, positioned by the two neck arms 115 extending from the top of the body portion 110 of the main bib 105, secured around the neck and over the shoulders of the baby, the right triangle, shaped shoulder fold 310 provides an approximate 35° degree tilt relative to a plane of the chest and tummy of the baby downward towards the baby's mouth. In particular, the positioned baby bottle is elevated at its bottom in a tilted nursing position. The tilted position ensures flow of liquid content to the bottle nursing baby without having to manually hold the bottle at a tilted angle.

Figure 12:
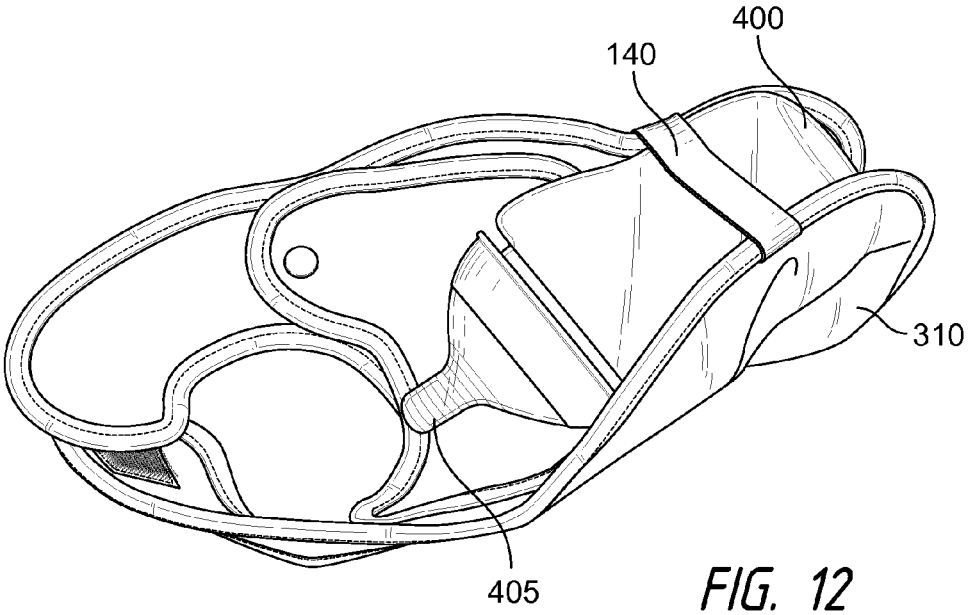

FIGS. 11 and 12 are representative isometric views of combined baby bib and bottle holder 100 with the bottle holder function implemented. As shown in FIG. 11, the bottle holder function may be implemented whether or not mini bib 200 is fastened to main bib 105. When main bib 105 is transformed to implement the bottle holder function, shaped shoulder fold 310 of the transformed main bib 105 rests on the baby's chest and tummy. The elastic strap 140 stretches to accommodate bottles 400 of different girth and shape.

Figure 13:
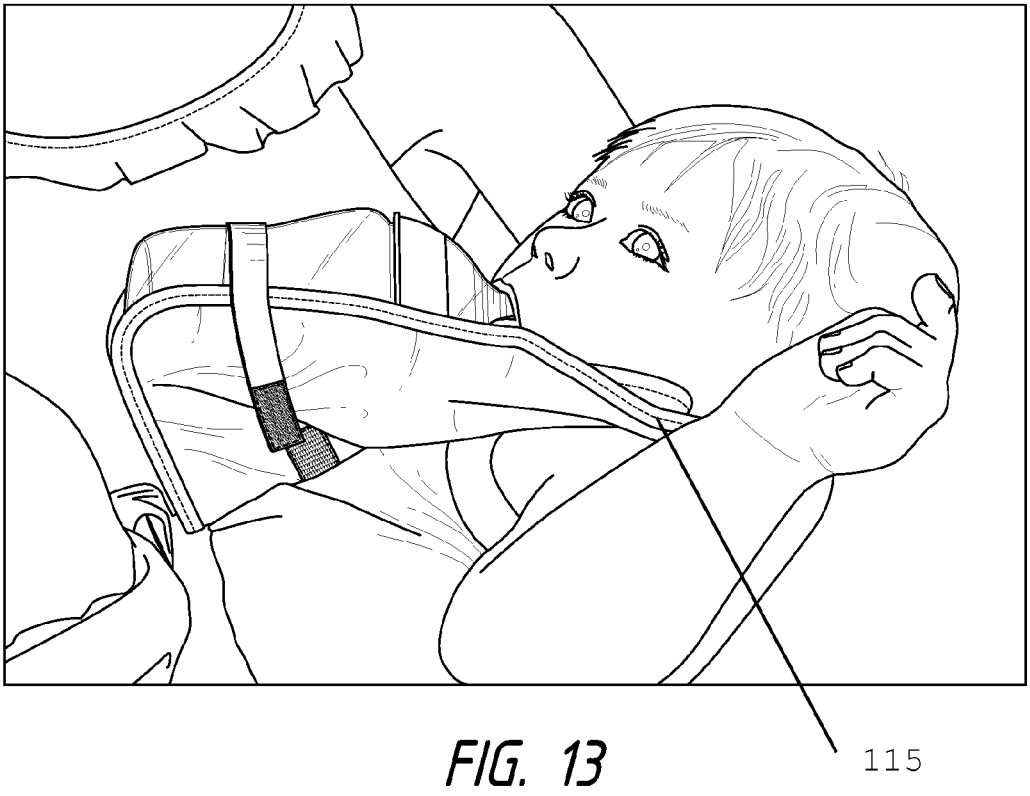
FIG. 13 shows a method of use of combined baby bib and supporting bottle holder 100 of the combined baby bib and bottle holder.

As shown in FIG. 13, a baby wears the combined baby bib and bottle holder 100 secured around its neck like any conventional bib. When the bottle holder function is implemented, the right triangle, shaped shoulder fold 310 rests comfortably and held securely on the baby's chest and tummy with the bottle 400 tilted towards the baby's mouth. The person holding the baby has a hand free, not having also to hold and position the bottle 400 for nursing. The nipple end of bottle 405 is comfortably received in the baby's mouth appropriately assuring liquid content within the nipple as the baby nurses. Moreover, any leaks are easily cleaned while the baby nurses. Additionally, when the bottle holder function is implemented, neck arms 115 wraps around the baby's cheeks on both sides, to further stabilize the bottle holder function position.

FIG. 14 is a representative top view of combined baby bib and bottle holder 100, where polyacetal resin snap fasteners, metal snap fasteners or rounded hook and loop fasteners 320*a* & 320*b* secured to the front surface of the main bib 105 proximate the base acute angles of the adjacent symmetrical right triangle pockets 150 and 155 secure the transforming fold creating the concave cradling support surface 305 and underlying the right triangle, shaped shoulder fold 310 instead of Neodymium magnets 170.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

For a better understanding of the invention reference is made to the following detailed description of the preferred embodiments thereof which should be taken in conjunction with the prior described drawings.

Unless defined otherwise, all technical and scientific terms used herein have the same meaning as commonly understood by one of ordinary skill in the art to which the combined baby bib and bottle holder belongs. Although any methods and materials similar or equivalent to those described can be used in the practice or testing of the combined baby bib and bottle holder, the preferred methods and materials are now described. All publications and patent documents referenced in the combined baby bib and bottle holder are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A combined baby bib and bottle holder for orienting and securing a baby nursing bottle at a tilted position for bottle nursing a baby comprising, in combination:

a) a flat flexible bib having a front and a back surface, and an integral oblong bib body having a front fabric layer, a back fabric layer, a bottom end, a central section, opposing side sections and a top end providing two elongated neck arms adapted to be secured around a baby's neck;

b) two symmetrical adjacent right triangle shaped insert pockets, centrally located at the bottom end of the bib body between the front and rear layers of the bib body, created by two hypotenuse seams joining the front and back fabric layers of the bib body establishing their hypotenuse edges that extend from the bottom end of the bib body and terminating at a seam apex located centrally in the central section of the bib body, and at least a common perpendicular seam joining the front and back fabric layers of the bib body that extends from the bottom end of the bib body, to the seam apex;

c) two symmetrical flat right triangular shaped bib inserts, each having a thickness and sized for snugly fitting inside each of the insert pockets, such that upon folding the bottom end the front surface of the bib body of the bib together along the common perpendicular seam joining the hypotenuses seams of the pockets containing the bib inserts, transforms the front flat bib surface into a concave cradle surface for receiving a nursing bottle, and transforms flat the back bib surface into a right triangle, shaped shoulder fold centrally underlying the concave cradle surface that extends from the seam apex in the central region of the bib body with increasing elevation toward the bottom end of the bib body for supporting the concave cradle surface;

d) means for securing and releasing the joined folded front surface of the bib body folded along the hypotenuses seams of the pockets; and e) a securing strap having a secured end permanently fastened to an oblong side edge of a bib side section of the bib body, and a free distal end located for wrapping and securing the opposing side sections of the bib body transversely around a nursing bottle located within the transformed front of the bib aligned with the underlying right triangle, shaped shoulder fold;

f) means for fastening and unfastening the free distal end of the strap to the back surface of the opposing side section of the bib body;

whereby, the secured nursing bottle is oriented by the central underlying right triangle, shaped shoulder fold in a tilted position inclined downward toward the top end of the bib body above the central section of the bib.

2. The combined baby bib and bottle holder of claim 1 further having a detachable, flat bow-shaped overlay portion, the overlay portion temporarily being fastened proximate to the top end of the bib body by mechanical means.

3. The combined baby bib and bottle holder of claim 2 in which the flat bow-shaped overlay portion further having a top, a middle and a bottom layers, the top and bottom layers being made of moisture absorbing fabric materials, the middle layer being made of water-proof materials, the top, the middle and the bottom layers sealed at their perimeters by bias tape seams.

4. The combined baby bib and bottle holder of claim 2 in where the detachable, bow-shaped overlay fastened proximate to the top end of the bib body is reversible.

5. The combined baby bib and bottle holder of claim 2 in which the bow-shaped overlay further having a detachable neck strap, the neck strap attachable to both sides of the bow-shaped overlay portion, creating a neck opening for the baby.

6. The combined baby bib and bottle holder of claim 5 in which the neck strap further having a top, a middle and a bottom layers, the top and bottom layers being made of moisture absorbing fabric materials, the middle layer being made of water-proof materials, the top, the middle and the bottom layers sealed at their perimeters by bias tape seams.

7. The combined baby bib and bottle holder of claim 1 where the two elongated neck arms further having means for cooperatively being coupled and decoupled around a baby's neck.

8. The combined baby bib and bottle holder of claim 1 in which the bib inserts are made of foam materials.

9. The combined baby bib and bottle holder of claim 1 in which the thickness of the bib inserts is in the range of ¼ inch to 1 inch.

10. The combined baby bib and bottle holder of claim 1 in which the temporary closing means to attach the top surfaces of the two insert pockets together consists of a snap closure, a magnetic closure, or a hook and loop closure.

11. The combined baby bib and bottle holder of claim 1 in which the securing strap is made of elastic fabric material.

12. The combined baby bib and bottle holder of claim 1 where the tilted position inclined downward toward the top end of the bib body ranges between 10° and 50°.

13. The combined baby bib and bottle holder of claim 1 where the front layer of the bib body is composed of moisture absorbing fabric materials and the back layer is composed of a non-permeable and non-toxic waterproof material, where the front and back layers are further sealed together at their perimeters by bias tapes.

14. A combined baby bib and bottle holder for independently cradling and securing a baby bottle tilted for bottle nursing a baby, comprising, in combination:

a) a flat bib formed integrally by an oblong bib body having:

(i) top and bottom ends and two elongated neck arms adapted to be adjustably secured around a baby's neck extending from the top end of the bib body;

(ii) two adjacent, symmetrical right triangle support panels each with a relatively rigid, thick insert and closed hypotenuse and base edges, having a common perpendicular closed edge, located with their base edges adjacent to the bottom end of the bib body, where the supporting panels can be folded together along their common closed perpendicular edge joining the respective closed hypotenuse edges for transforming the flat bib into a structure with a concave cradle front surface, and an underlying back surface with a right triangle, shaped shoulder fold centrally underlying the cradle surface that extends from an apex point in a central region of the bib body with increasing elevation toward the bottom end of the bib body for orienting the concave cradle surface for tilting a nursing bottle at a predetermined angle toward the top end of the bib body;

b) means for coupling and uncoupling the supporting panels folded together along their closed common perpendicular edge with their respective closed hypotenuse edges joined, and c) a securing strap attached to an oblong side edge of the bib body that can be transversely wrapped around and unwrapped from around the bib body for securing side portions of the bib body around a baby bottle for securely aligning the baby bottle with the right triangle, shaped shoulder fold centrally underlying the cradle surface of the transformed flat bib structure.

15. The combined baby bib and bottle holder of claim 14 further having a detachable, flat bow-shaped overlay portion, the overlay portion composed of a moisture absorbing fabric attached at the top end of the bib body by mechanical means.

16. The combined baby bib and bottle holder of claim 15 wherein the bib body has a front and a back layer, and wherein (iii) the hypotenuse, and base edges and the common perpendicular edge of the adjacent symmetrical support panels are closed by seams securing the front and back layers of the bib body together.

17. The combined baby bib and bottle holder of claim 1 in which the bases of the symmetrical right triangle pockets are completely sealed along the bottom end of the bib body.

18. The combined baby bib and bottle holder of claim 1 in which the bases of the symmetrical right triangle pockets are partially sealed along the bottom end of the bib body.

19. The combined baby bib and bottle holder of claim 1 in which the bases of the symmetrical right triangle pockets are open along the bottom end of the bib body.

20. The combined baby bib and bottle holder of claim 14 where the insert of the supporting panels are made of foam material and the thickness is in an range of ¼ inch to 1 inch.

* * * * *